US007591093B2

(12) United States Patent
Saylor

(10) Patent No.: US 7,591,093 B2
(45) Date of Patent: Sep. 22, 2009

(54) PULL-OUT INDEX FOR FILE FOLDERS AND THE LIKE

(76) Inventor: Mirelle Saylor, 22 Diane La., Larkspur, CA (US) 94939

( * ) Notice: Subject to any disclaimer, the term of this patent is extended or adjusted under 35 U.S.C. 154(b) by 1203 days.

(21) Appl. No.: 09/999,766

(22) Filed: Oct. 24, 2001

(65) Prior Publication Data

US 2003/0074817 A1 Apr. 24, 2003

(51) Int. Cl.
*G09F 7/00* (2006.01)
*G09F 11/00* (2006.01)

(52) U.S. Cl. ..... 40/488; 40/490

(58) Field of Classification Search ..... 40/360, 40/374, 375, 488, 490, 491
See application file for complete search history.

(56) References Cited

U.S. PATENT DOCUMENTS 223,569 A * 1/1880 White ..... 40/491
854,971 A * 5/1907 Thomas ..... 40/338
1,603,592 A * 10/1926 Glasner ..... 446/147
2,923,070 A * 2/1960 Resnick ..... 434/219
3,991,495 A * 11/1976 Wilson ..... 40/375
5,992,073 A * 11/1999 Wolpa ..... 40/651

FOREIGN PATENT DOCUMENTS

GB 2160691 A * 12/1985

* cited by examiner

*Primary Examiner*—Cassandra Davis
(74) *Attorney, Agent, or Firm*—Jill L. Robinson

(57) ABSTRACT

A pull-out index for physical file folders, books, boxes and the like is shown which includes a record device that has a surface for recording information about the contents of the folder, is slidably enclosed in a pocket formed by a holder that is attachable to the folder. The record device may be constructed to have a portion of tabs near the bottom edge. Stops placed at the top edge of the pocket cooperate with the tabs to prevent the record device from inadvertently being removed from the pocket while allowing the user access to the information recording surface.

2 Claims, 13 Drawing Sheets

PULL-OUT INDEX FOR FILE FOLDERS AND THE LIKE

BACKGROUND OF THE INVENTION

Despite the wide-spread use of computers and the claimed inevitability of a "paperless" office, paper files continue to be ubiquitous in the business world, academia and the home. Often, a document can be filed in more than one file, forcing the user to make a choice between files unless multiple copies of a document are made. Unfortunately, when this occurs, it is later often difficult, if not impossible, to determine the location of a particular document without reviewing the contents of multiple paper files. This is a time consuming, and potentially physically demanding, process, particularly if the files in question must be removed from file drawers, shelves or boxes prior to review and are to be placed back after review.

SUMMARY OF THE INVENTION

In view of the foregoing, it is an object of the present invention to provide a device which will allow the user to more easily keep track of the contents of paper file folders, so that the contents of a file can be easily determined without opening the file itself. It is a further object of the present invention to provide a device that can be used with all major existing types of file folders. It is a further object of the invention to provide a device that allows the user to determine the contents of a file without removing the entire file from its location on a shelf or in a box or file drawer. Additionally, it is desirable that the device be easy to manufacture and use and allows the user to easily update information as the contents of a particular file change.

Although some currently available files folders do include lines or an area on the outside of the folder for notations (including, presumably, notes on the contents of the file), such folders do not easily allow for updates to the information and usually require removing the entire file from a box or shelf in order to review the notations. Further, it is usually impractical to modify folders that have not been manufactured with lines or space for notations to allow for notations about file contents.

In view of the foregoing, the current invention comprises a file record device, on which an index—or simply identifying titles or short descriptions—of the documents in the file can be written, in a holder that can be attached to a file folder. The file record is movable relative to the holder, and thus to the folder, so that when the folder is in a box or file drawer, or on a shelf, the record may be moved to a more easily readable position without opening the folder or, if properly positioned on the folder, without even moving the file folder itself. Additionally, the device may include features such as: a file record that is removable entirely from the holder to allow for easier updating of the record on a typewriter, computer printer or by hand, or replacement of the entire record; a file record with an erasable surface to allow for easier updating and revision of the file record as the contents of the file change; and a holder that includes a protective, preferably clear, covering for the file record when the record is not in use. While intended primarily for file folders, the device could also be used on any physical container designed for holding a variety of documents, references or items where movement or opening of the container to determine its contents is not always desirable; for example, the device could be attached to storage boxes, shelves containing multiple files, record books, and the like.

DETAILED DESCRIPTION OF THE DRAWINGS

Figure 1A:
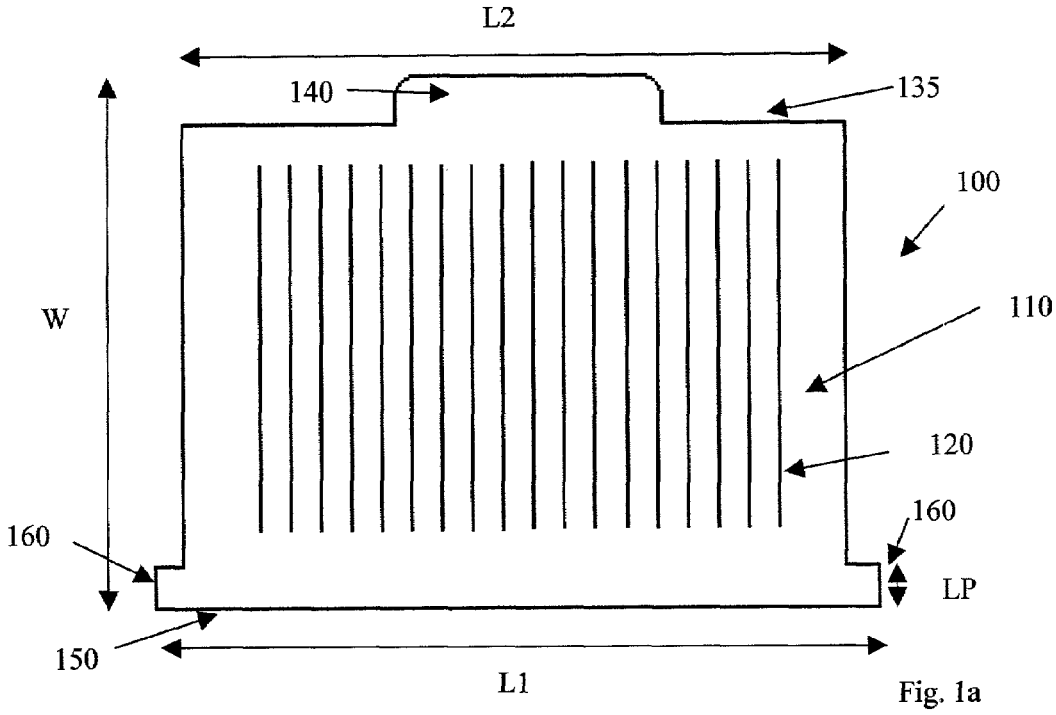
FIGS. 1*a* and 1*b* show possible embodiments of a record device.
Figure 1B:
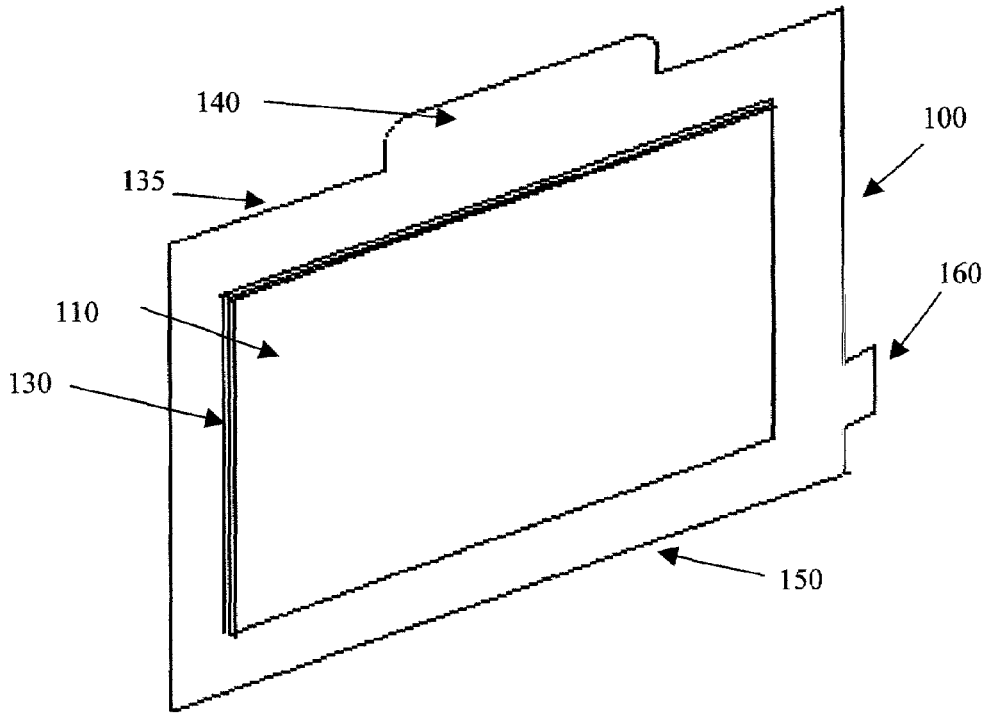

With reference to FIGS. 1*a* and 1*b*, a record device 100 is shown. The file record 100 would usually be rectangular (including square) and substantially flat or planar. The file record 100 includes at least one surface 110 suitable for writing, typing or otherwise placing (i.e., by use of labels and the like) information regarding the contents of the file to which it may be attached. The surface may be marked with lines 120, as is shown, or other guides including numbers, boxes, bullets, etc. that allow the user to more easily enter and read the information. Although more permanent entries of information may be desirable for some applications, the surface 110 may be erasable or comprise a thin pad of paper 130 so as to allow changes and/or reuse of the file record if an appropriate writing implement is used to record the information. It is anticipated that depending on the material selected for the surface 110 different writing implements may be used to place the information on the surface. For example, if the surface is cardboard or includes paper, the surface may be erasable if a pencil or appropriate pen is used. If an appropriate plastic surface is selected a wax pencil may be used. Glue-backed labels may also be an alternative for use with any surface that will allow both continued attachment of the label through repeated use and removal of the label when appropriate, although it may also be possible to simply cover old labels with new ones when the contents of the file are modified. It will be evident to those of ordinary skill in the art that in certain cases even typewritten and ink entries may be erasable and therefore the descriptions above matching particular surface types with particular writing instruments do not include all possibilities and are intended to be non-limiting.

The record device 100 is preferably made of material(s) that cause the record device 100 to be of sufficient stiffness to allow a user to pull the record device 100 from its holder (as further described below in the text associated with FIGS. 2-9)

easily and repeatedly without damage to the record device 100. Generally, a single sheet of standard 20 or 25 lb paper alone would not be of sufficient stiffness, although as suggested in the previous paragraph, paper could be attached to another material to form a record device of sufficient stiffness to meets the design requirement. The device must, however, be thin enough to allow the record device 100 to fit into a holder as described below. Some flexibility would not normally be detrimental to most designs, and may be preferable in certain applications. Thick paper or cardboard are materials that may be used, and a glossy surface may be applied to allow for erasure as described in the previous paragraph. Another alternative is a suitable plastic, such as 1/64 inch or 0.4 mm thick acrylic, although thinner or thicker sheets may also be used depending on the nature of the particular plastic selected.

The width W of the record device must be selected to allow a pull tab 140, or a sufficient portion of the top edge 135 itself, to extend beyond the top of the holder 200, 600, 800, 900, as shown in FIGS. 5*a*, 6*a*, 8*a* and 9*a*, and allow the user to pull the record device 100 from the holder as further described below.

The length L1 at or near the bottom edge 150 of the record device 100 is generally longer than the length L2 of the top edge. This may be accomplished by one or more protrusions 160 having a length LP placed at the bottom edge 150 of the record device 100 as shown in FIG. 1*a*. Alternatively, as shown in FIG. 1*b*, the protrusion or protrusions 160 may be placed near the bottom edge 150 which may be more effective with certain types of holders. The position of the protrusions 160 preferably allows for a portion of the recording surface 110, sufficient to read and/or record information, to be fully removed from the holder by the user as further set forth in the text describing FIGS. 5, 6, 7, 8 and 9. The length L2 is usually maintained along that portion of the width W that is intended to be accessible to the user when the record device is in use as further described below. However, it would also be possible to have varying lengths, shorter than L2, along that portion of width W.

With reference to FIG. 2, an embodiment of a holder 200 is shown. The holder 200 includes a substantially flat front unit 210 attached to a substantially flat back unit 220 to form a pocket 230 that is suitable for containing an appropriately selected, slideable record device, as further discussed below. As shown, the pocket 230 is substantially rectangular and thus units 210, 220 are also usually, but not necessarily required to be rectangular. Depending upon the quality of the material(s) selected for each of the front and back units, and the thickness of the selected record device, the attachment may be effected by simply gluing or melding the two units together along side and bottom pocket edges 240, 241. Generally, such an attachment would be suitable if the record device is relatively thin. It will also be evident that the bottom edges of the units 242 may be essentially the same as the bottom pocket edge 241. This may be achieved by unitarily constructing the front and back units 210, 220—for example, by folding a single sheet of material to form the two units with the fold as the bottom edge 241, 242 of both the front and back units 210, 220 and the pocket 230, as is shown in FIG. 2*b*. Additionally, as shown in FIG. 2*b*, the side edges 250 the holder 200 may be essentially the same as the side edges 240 of the pocket 230. As persons of ordinary skill in the art will appreciate, this may be achieved in a number of ways, including appropriate folding of the material used to form the front and back units of the holder, melding or gluing the units close to the edge of the material, or a manufacturing process that allowed the holder 200 to be formed in essentially one piece.

Figure 3A:
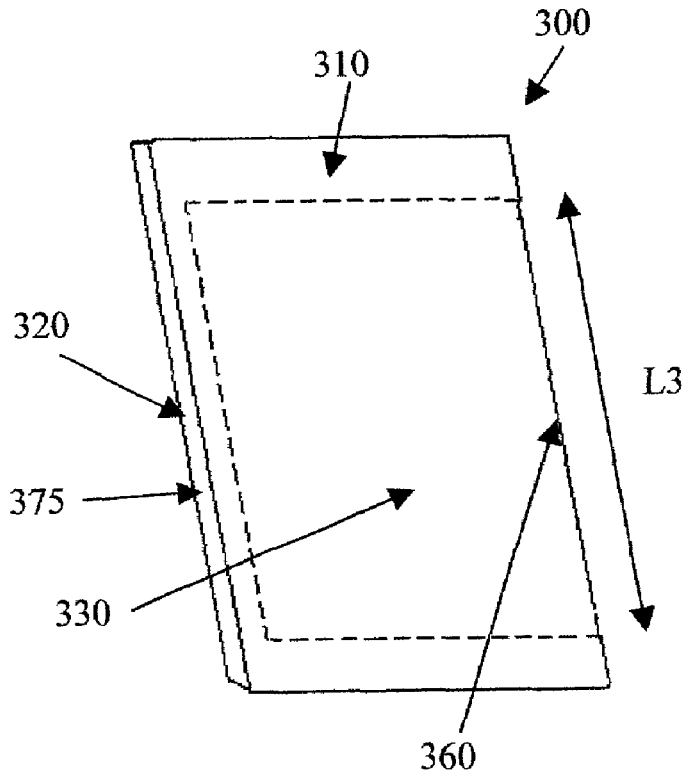
FIGS. 3*a*, 3*b* and 3*c* show an alternative embodiment of the holder.
Figure 3B:
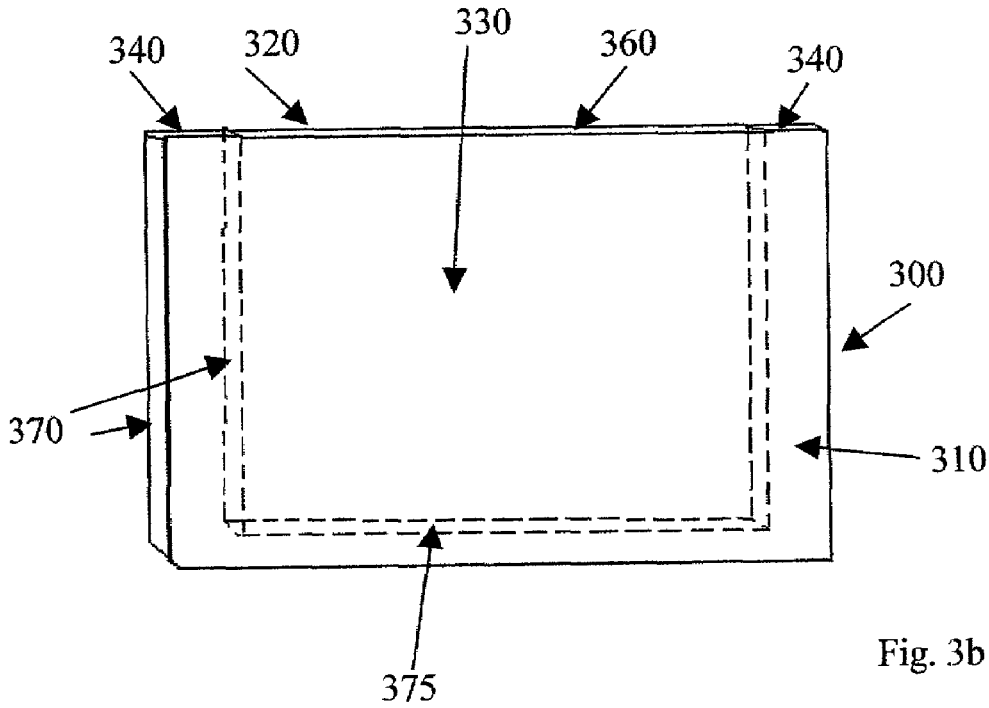
Figure 3C:
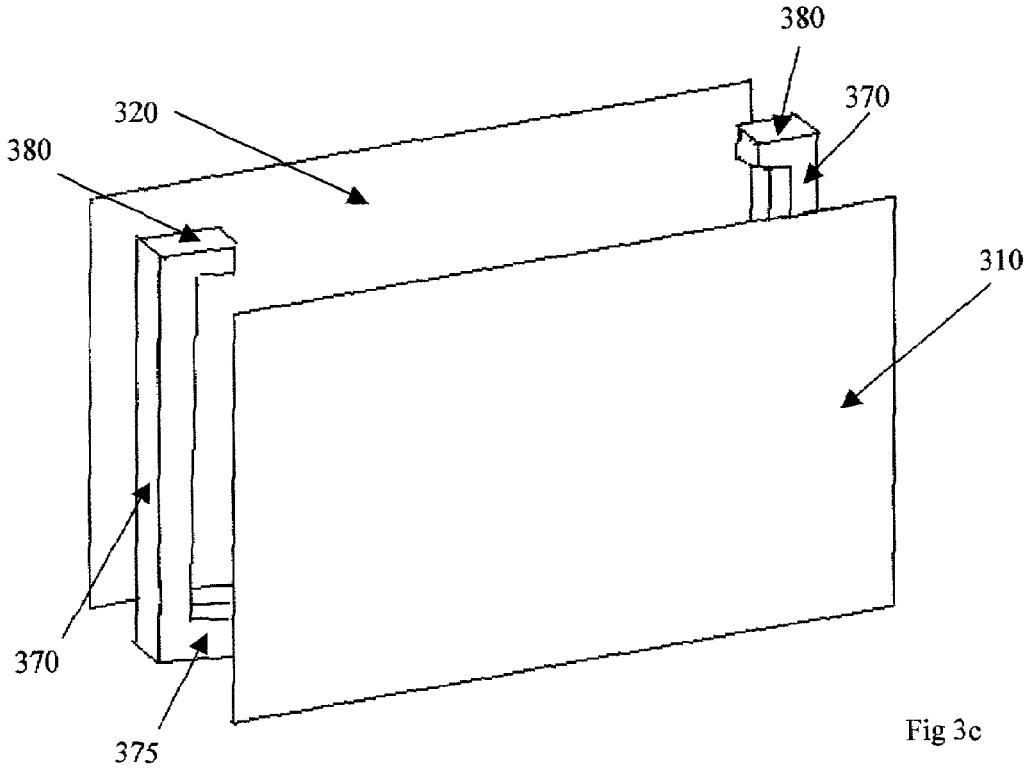

In order to accommodate certain types of record devices, particularly those record devices that are relatively thick, the holder may also be formed in a more box-like shape 300 as shown in FIGS. 3*a* and 3*b*. Rather than merely bonding the front and back units 310, 320 together, the front and back units are attached together by way of thin side units 370 and bottom unit 375 along the perimeter of both the holder 300 and the pocket 330, and by top units 340, creating more space in the pocket 330 between the front and back units 310, 320 to accommodate a thicker record device. The same effect may be achieved by use of a "sandwich" construction as shown in FIG. 3*c*. The side units 370 and bottom units 375 may be of unitary construction sandwiched between front and back units 310, 320. Stops 380, the function of which is further described below, may also be included in unitary construction with the side and bottom units 310, 320.

Figure 6A:
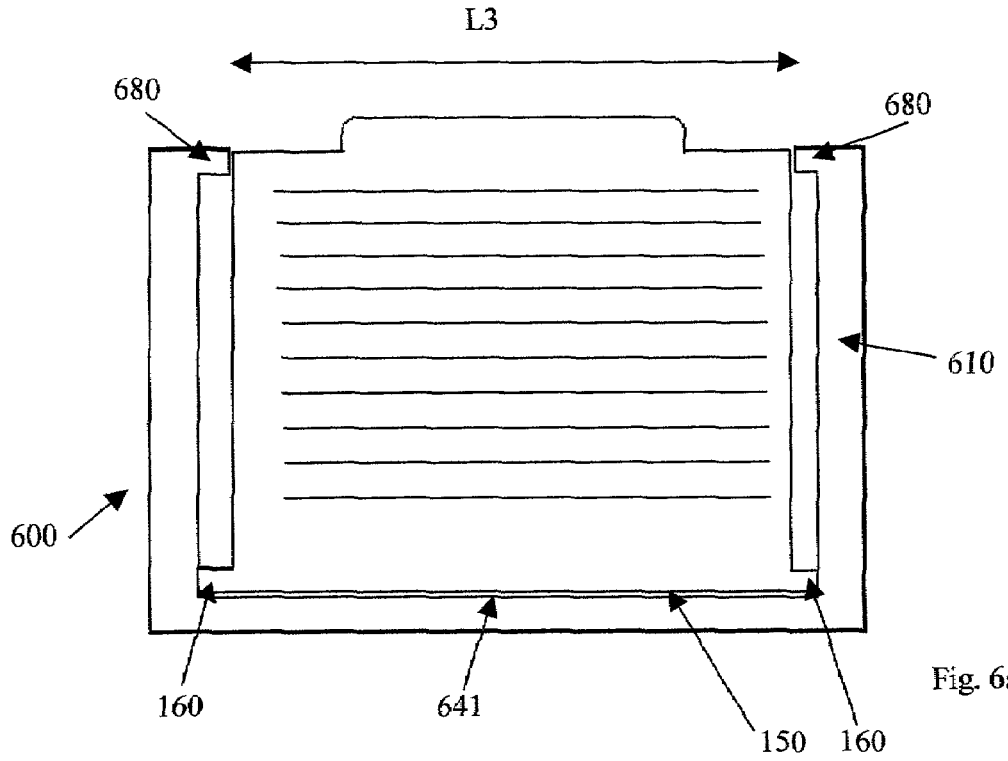
FIGS. 6*a* and 6*b* show a second embodiment of the invention in two positions.
Figure 6B:
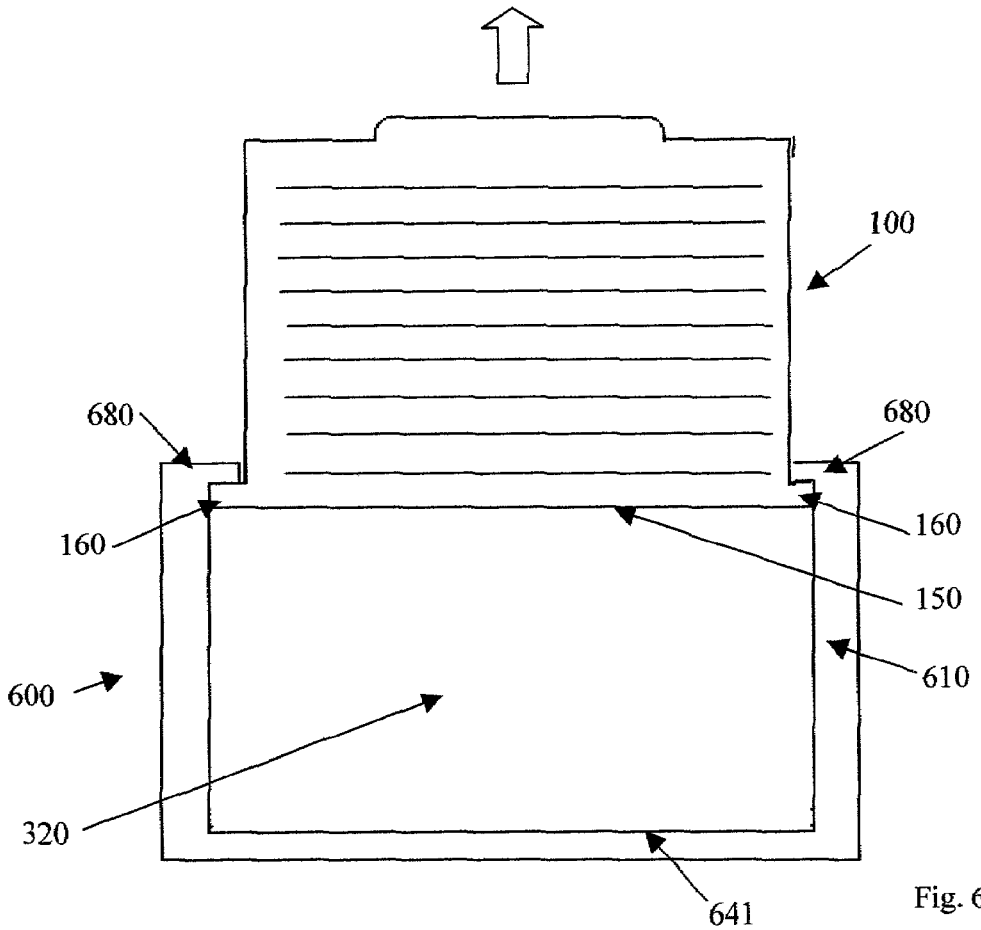
Figure 6C:
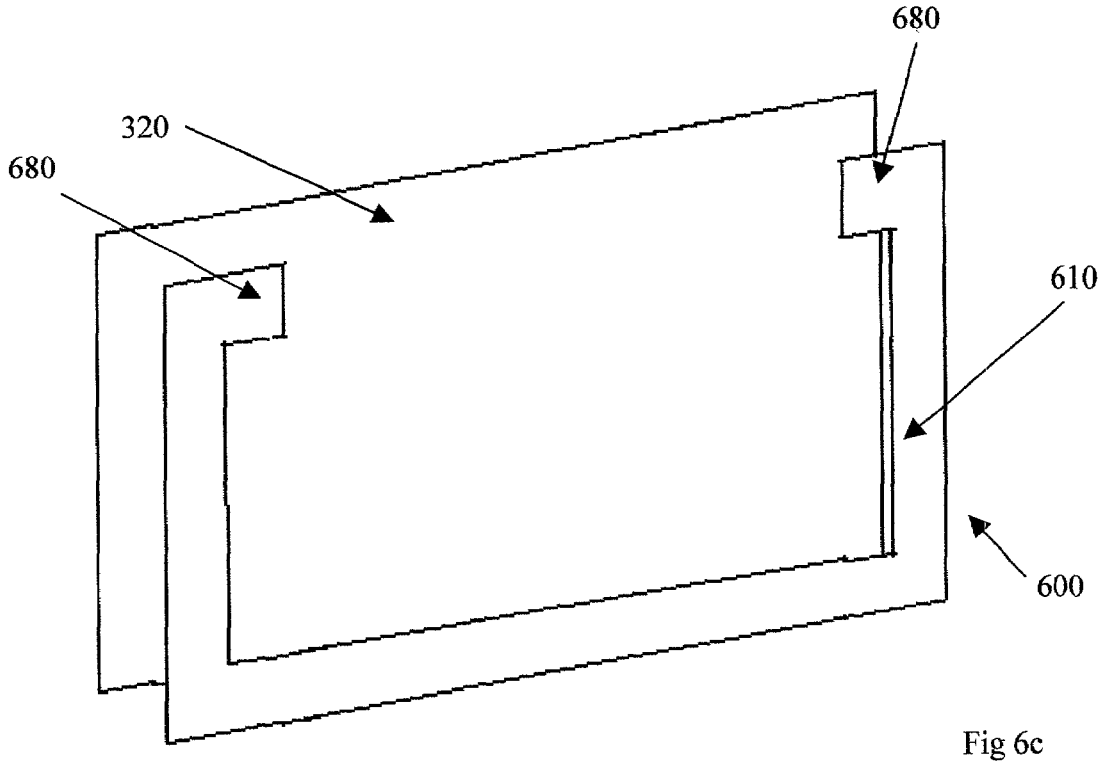
FIG. 6*c* shows an embodiment of the holder from FIGS. 6*a* and 6*b*.
Figure 6D:
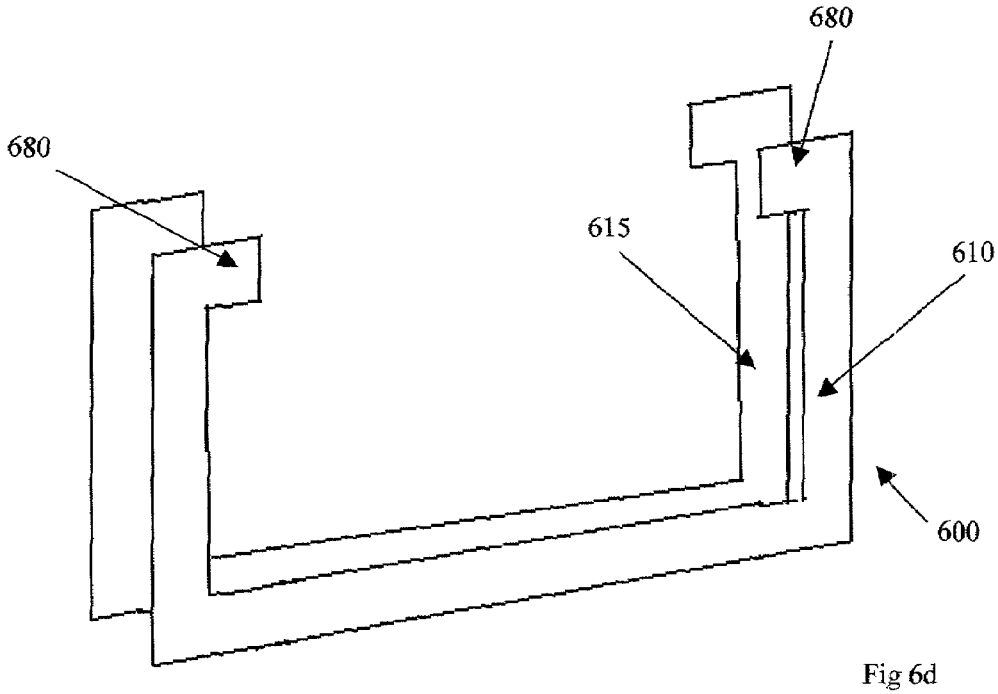
FIG. 6*d* shows an alternative embodiment of the holder.

With reference to FIG. 6, as an alternative construction of the holder 600, the front and/or back units may be substantially "U" shaped as the front unit 610 is shown in FIGS. 6*a-c*. Such a construction of the front unit 610 leaves at least a portion of the recording surface 110 accessible by the user even when the record device 100 is essentially not extended from the holder 600. Similarly, the back unit may also be formed as a "U". FIG. 6*b*, represents a view of the holder 600 when the record device 100 is extended from the holder. FIG. 6*c* shows the basic construction of the holder 600 with a "U" shaped front unit 610 and rectangular back unit 320 while FIG. 6*d* shows a construction of the holder with both a "U" shaped front unit 610 and back unit 615.

Finally, as shown in FIG. 9, it is also possible for a device to include a holder 900 comprising only a front unit 910. The surface 990 of the file folder, box, or other item to which the device is attached acts in place of the back unit.

The top 260, 360, 660, 960 of the holder 200, 300, 600, 900 is open along length L3; that is, length L3 represents the opening at the top of the pocket. Length L3 is substantially the same as the length L2 of the record device 100, so as to allow a record device that is contained in the pocket of the holder 200, 300, 600, 900 to be slidably removed or partly removed from the holder 200, 300, 600, 900 when the top 135 of the record device 100 or the tab 140 is pulled.

Figure 4A:
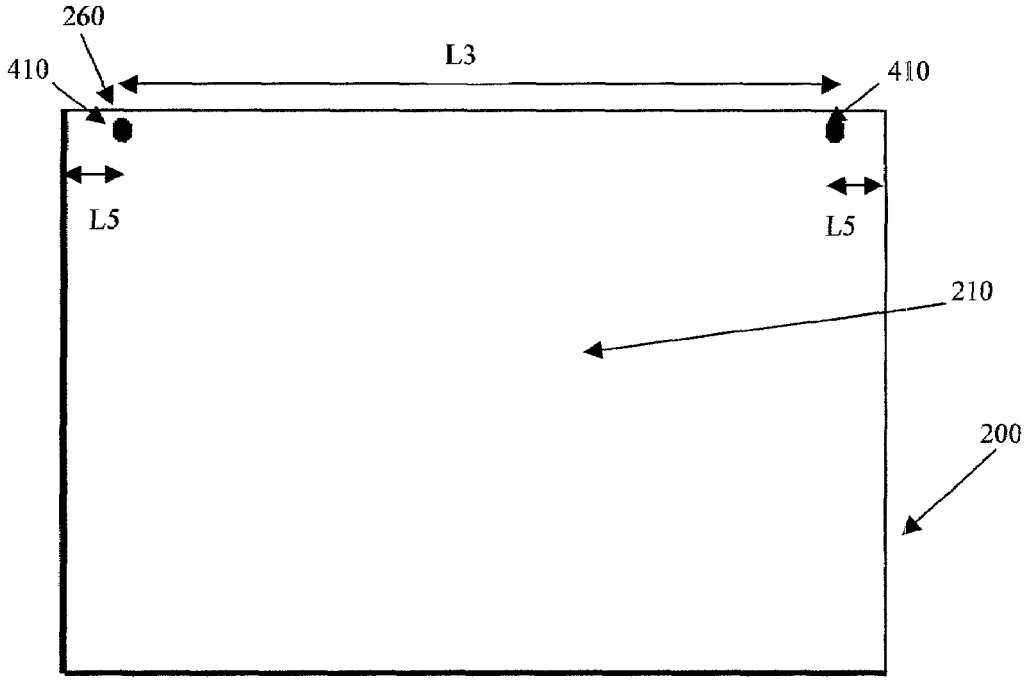
FIGS. 4*a* and 4*b* show other alternative constructions of the holder with snap fasteners and a hook-and-loop fastener used for "stops".
Figure 4B:
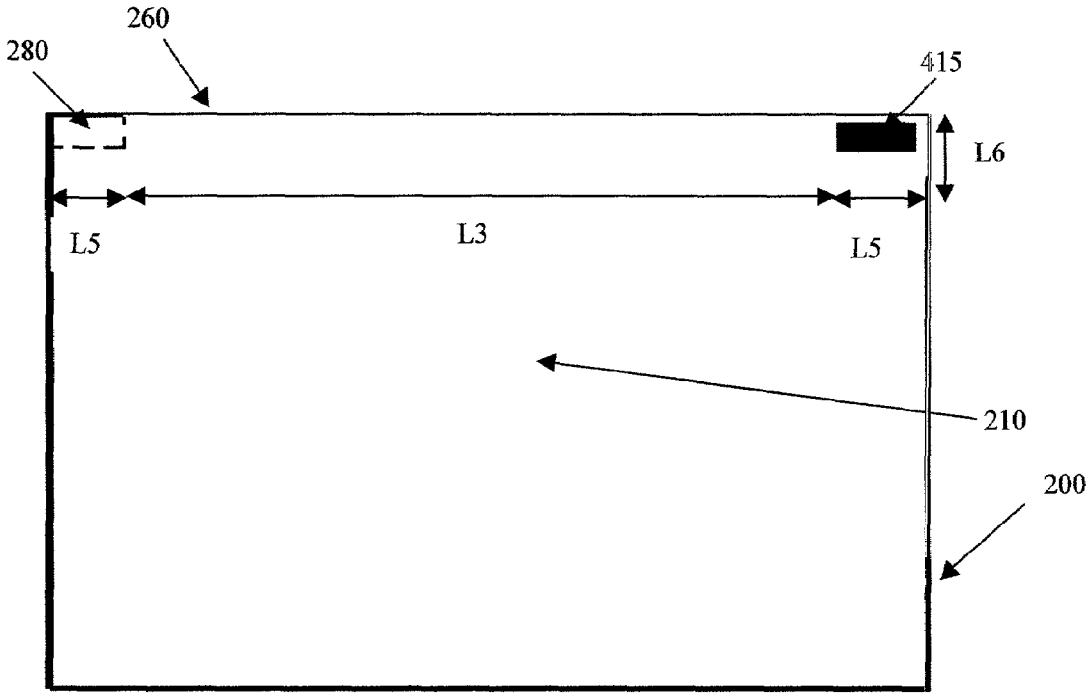
Figure 5A:
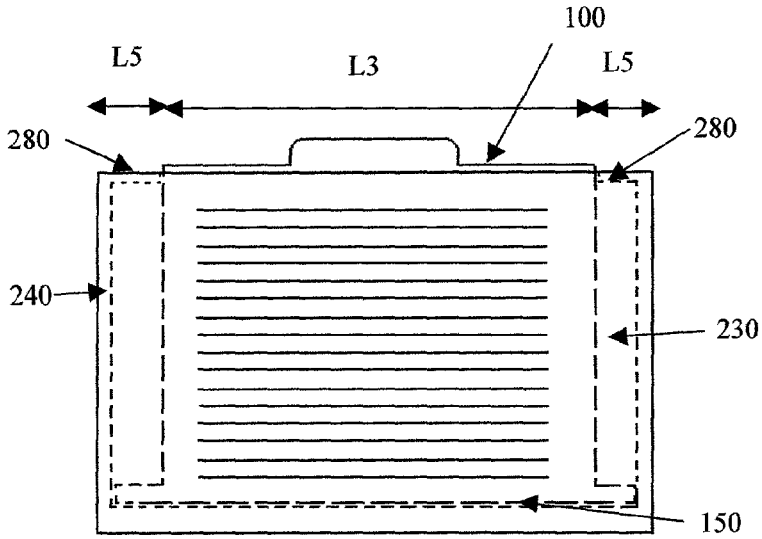
FIGS. 5*a* and 5*b* show a first embodiment of the invention including the record device and holder in two positions.
Figure 5B:
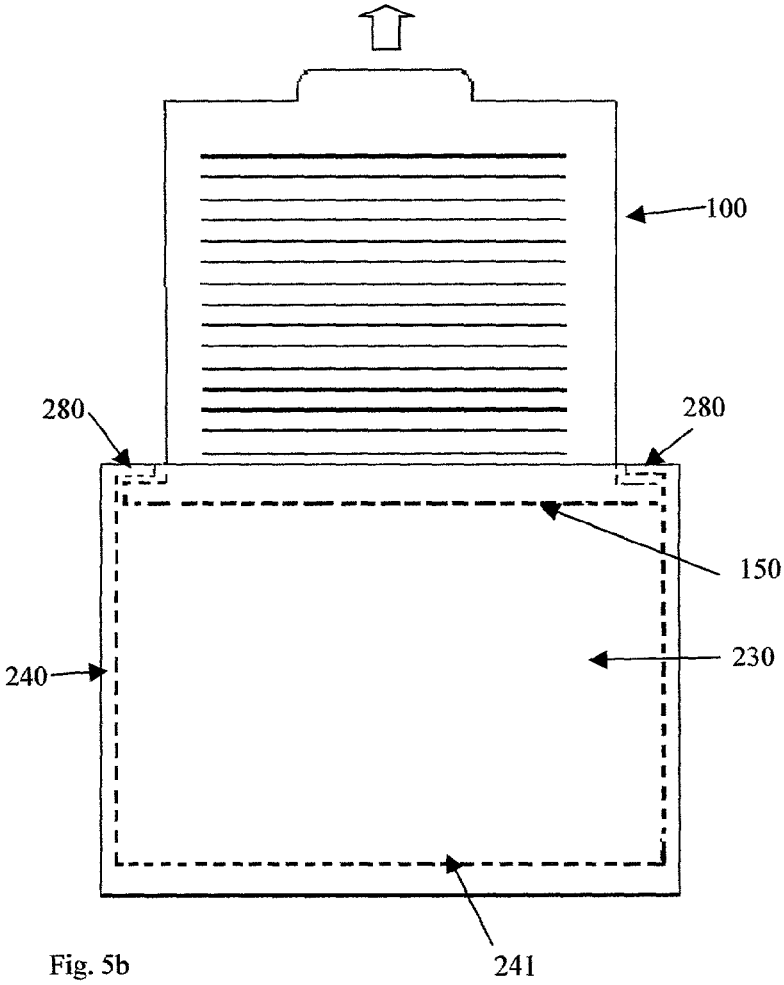

Preferably, the holder 200 also includes a melded or glued portion to form a stop or stops 280 at or near the top 260 of the holder and at the edge of the pocket opening 230. The stop or stops 280 may be formed by melding or gluing the front and back units 210, 220 together (or attaching the units indirectly through thin units similar to those shown in FIG. 3 as top, side and bottom units 340, 370, 375) from the edge of the pocket 230 opening along some portion, or all, of length L5. Alternatively, the stop or stops may be created by the use of snaps 410 as shown in FIG. 4*a*, hook-and-loop tape 415 such as VELCRO brand, as shown in FIG. 4*b* or other reversibly closable fastener(s) attached near the top 260 of the holder 200. This alternative has the advantage of allowing the record device 100 to be completely removed from the holder 200 by the user so that the user can more easily update information on the record device—including, depending on the type of material selected for the record device 100 and the thickness of the record device, on a typewriter or computer printer. In the embodiment shown in FIG. 9, the stops 980 may be formed by adhesive along length L5 placed on the back of the front unit 910 which is attached to the file, box or the like to which the device is mounted.

It will be appreciated that while FIGS. 2, 4, 5, 6 and 9 show particular shapes of stops—a circular snap 410, a rectangular hook-and-loop tape fastener 415—these shape are only examples and other shapes are possible. For example, rather than a melded or glued seal along all of length L5 as shown, a spot meld could be made at the interface between L3 and L5. It will also be appreciated that combinations of stops could be used: for example, it may be advantageous to have one stop that is glued or melded, and one stop that is formed by a snap or hook-and-loop fastener to allow for removal of the record device. For this last embodiment, shown in FIG. 4*b*, a small portion of the sides L6 of the front 210 and back units (not shown in the Figure) may be left unattached at the top of the pocket to make removal of the record device from the pocket easier. It is important to note that the position and shape of the stops depend in part on the position and shape of the protrusion(s) 160 of the record device to be used so that the holder and record device may function together as described in more detail below.

Figure 8A:
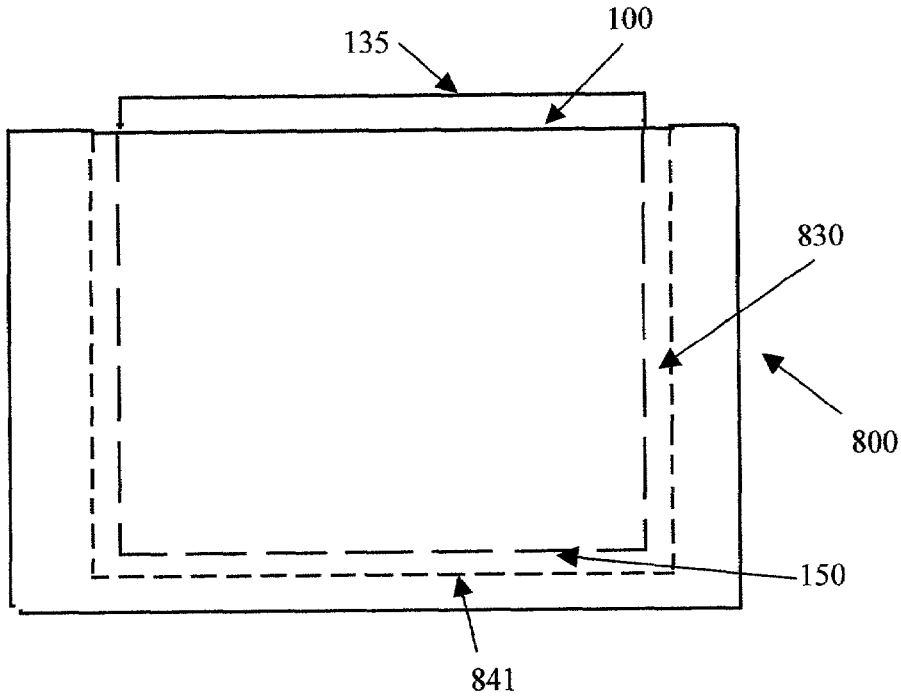
FIGS. 8*a* and 8*b* show a third embodiment of the invention in two positions.
Figure 8B:
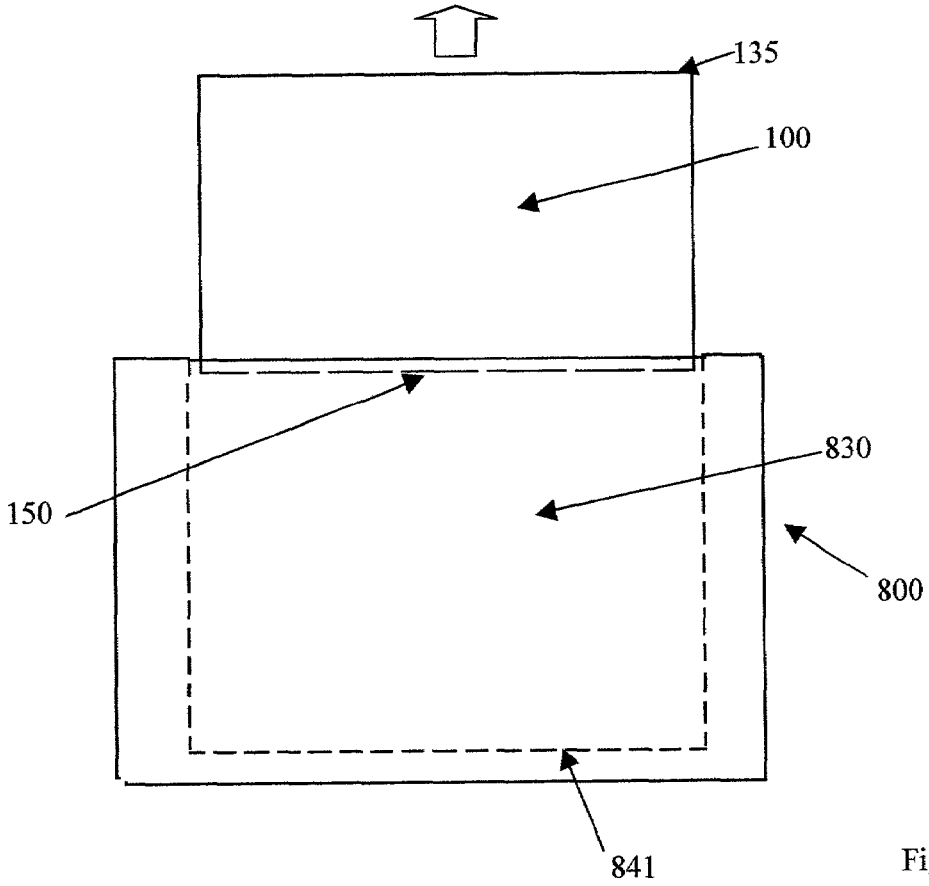
Figure 9A:
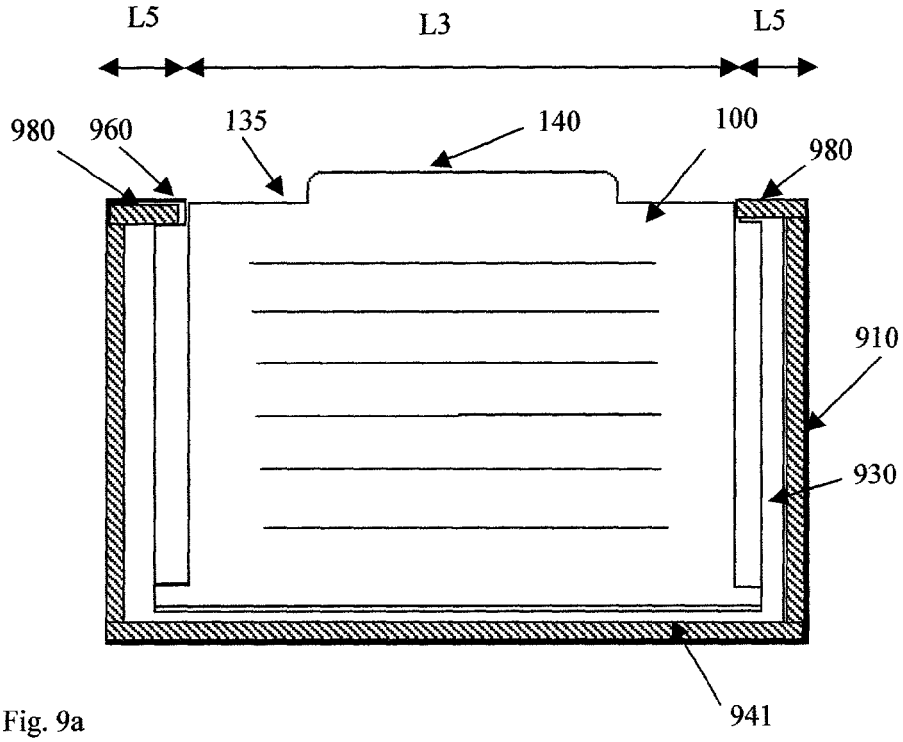
FIGS. 9*a* and 9*b* show a fourth embodiment of the invention before and after attachment to a file folder.
Figure 9B:
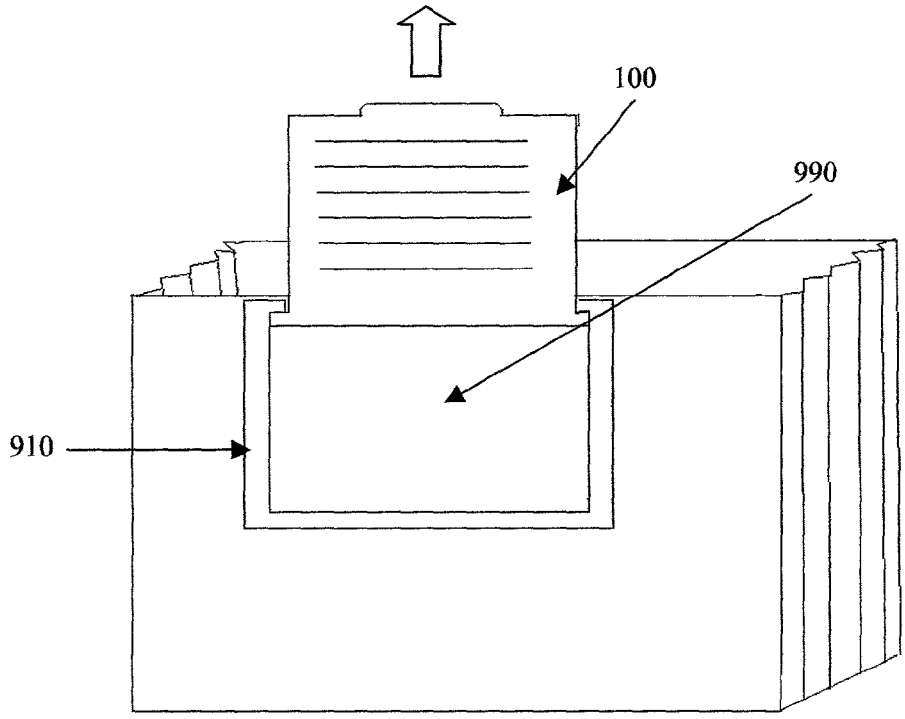

Although the stops and protrusions are desirable to prevent the loss of the record device or the inadvertent placement of a record device on the wrong file folder, it is also possible to have a record device without protrusions and/or a holder without stops as is shown in FIGS. 3 and 8. In such case either the length of the opening L3 of the holder is substantially the same or slightly larger than the maximum length L1 of the record device with which it is to be used. The record device need not include protrusions, and therefore the maximum length L1 of the record device may be simply length L2 if the record device is rectangular.

The holder may be constructed of a number of different materials. One possibility is clear plastic, or other thin transparent material, sturdy enough to tolerate a repeated, sliding movement of the record device into and out of the pocket. Flexible vinyl may be used (a 1/64 inch or 0.4 mm thick flexible vinyl has been used successfully), but other clear, plastic materials with less flexibility may also be appropriate. It is also possible to use cardboard, thick paper, plastic, or any relatively thin material that is sturdy enough to tolerate a repeated, sliding movement of the record device into and out of the pocket. It is also possible, of course, to use two type of materials for the holder. For example, a substantially clear material, such as vinyl, could be used for that portion of the holder that covers the recording surface when the record device is wholly inserted into the holder, while a sturdier material may be used to form the other portions of the holder, so as to allow the user to read the information on the recording surface even when the record device 100 is not completely extended from the holder. It is preferable that the materials used be thin enough so as not to prevent or impede a user from removing or replacing a file or the like, to which the device is attached, from a shelf, file drawer or box, or to add substantial volume to the file.

Figure 2A:
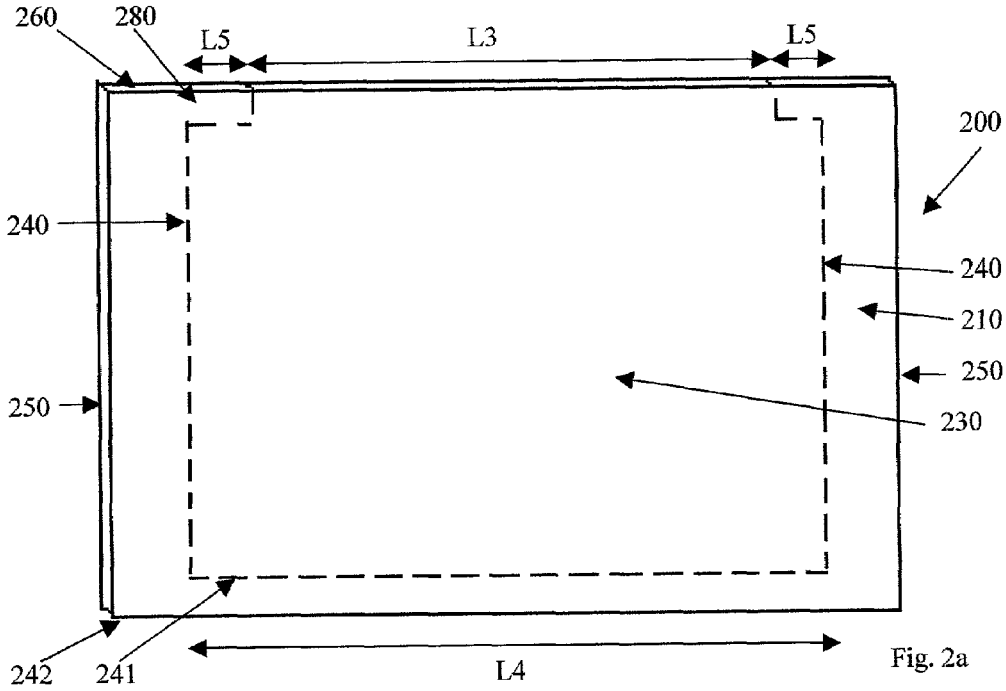
FIGS. 2*a*-2*d* show an embodiment of a holder for the record device including two variations of "stops" and possible patterns for adhesive.
Figure 2B:
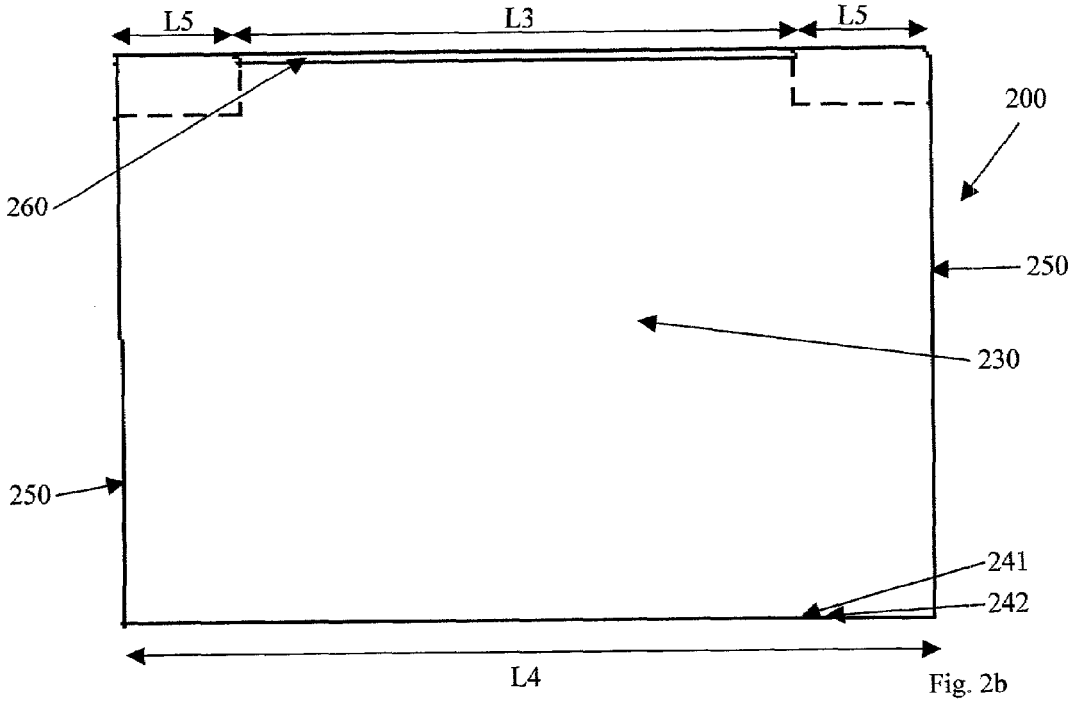
Figure 2C:
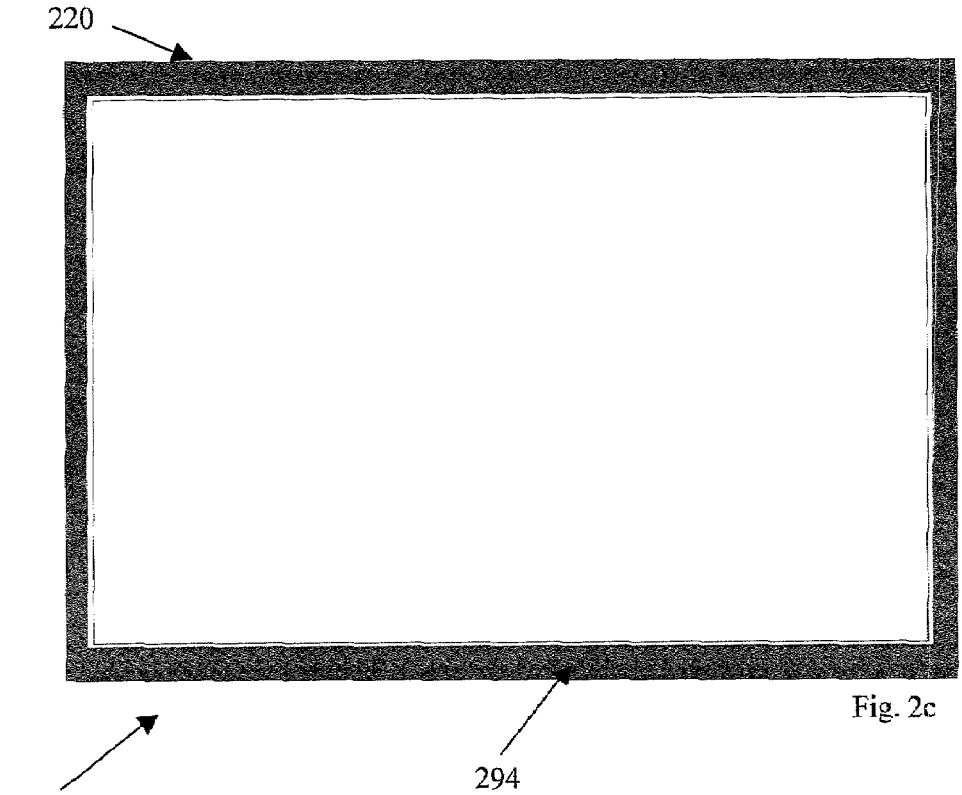
Figure 2D:
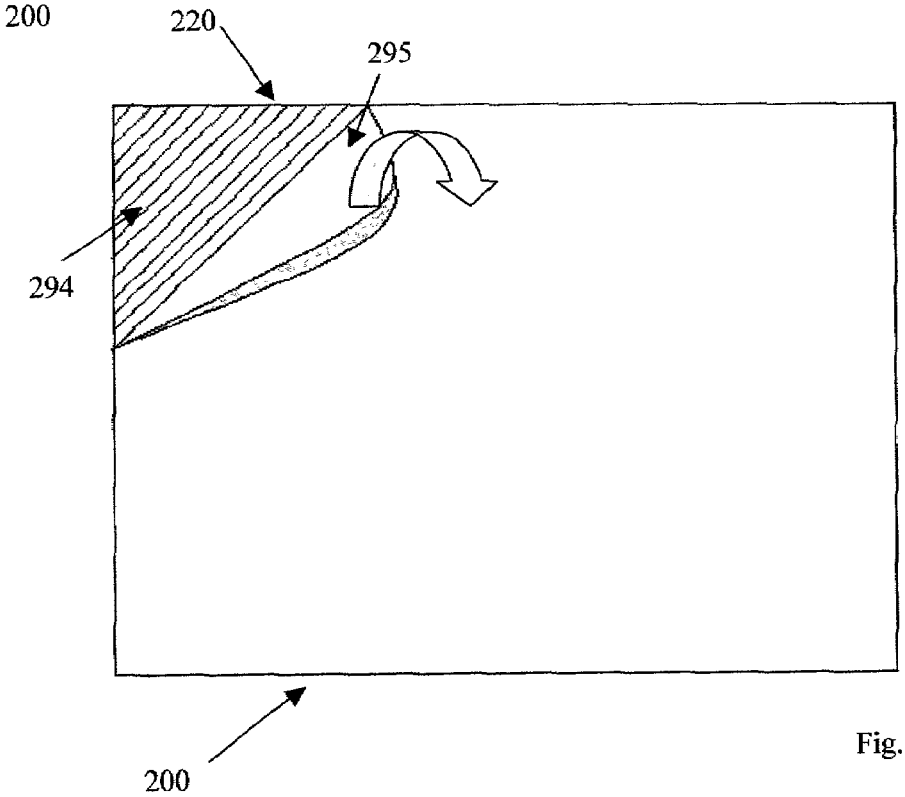

The exterior surface of the back unit 220 preferably includes an area of adhesive 294 sufficient to attach the device to a file, box or the like. While this area of adhesive is shown in connection with the embodiment shown in FIG. 2, all of the embodiments shown preferably include such an area of adhesive. As persons of ordinary skill in the art will appreciate, the area of adhesive may be placed along an edge or edges of the device as shown in FIG. 2*c*, or on all of the exterior surface of the back unit 220 as shown in FIG. 2*d*, or on any portion thereof. For the embodiment of the invention shown in FIG. 9, the adhesive 990 would be placed along the edges of the rear surface of the front unit 910 to form both the pocket 930 and, if desired, the stops 980. Placement on a file or the like of the embodiment shown in FIG. 9 would require that the record device 100 be placed inside the area of adhesive (which would form the pocket upon attachment) while the device was being attached to the file. As shown in FIG. 2*d*, the area of adhesive 294 may be covered with removable paper 295 or similar protection so as to prevent the unintentional attachment of the device to undesired surfaces. One adhesive that includes removable paper which may be used in the embodiments shown is PEELnSTICK brand double-sided adhesive, which is produced by Therm O Web company.

With reference to FIGS. 5, 6, 8 and 9, the combination of the record device 100 and the holder 200, 600, 800, 900 is shown. FIGS. 5*a*, 6*a*, 8*a* and 9*a* show the record device 100 fully inserted in the pocket 230, 630, 830, 930 so that the bottom edge 150 of the record device is against or close to the bottom 241, 641, 841, 941 of the pocket 230, 630, 830, 930. The record device 100 is not attached to the pocket 230, 630, 830 930 or otherwise to the holder 500, 600, 800, 900. Thus, by pulling the tab 140, or that portion of the upper edge 135 of the record device that extends from the pocket 230, 630, 830, 930 when the record device is fully inserted into the pocket, the user may slide the record device 100 out of the pocket until the protrusion or protrusions 160 meet the stops 280, 680, 980 which prevents the record device from being completely removed from the pocket. In the alternative embodiment wherein the holder does not have stops, such as is shown in FIG. 8, the record device may be completely removed from the pocket. It will be understood that for the holder shown in FIG. 4, the record device 100 would be able to be removed from the holder after unsnapping or otherwise separating the stops 410, 415. Such reversibly connectable stops could be used in any of the embodiments shown in FIGS. 5, 6 and 9. Each of FIGS. 5*b*, 6*b* and 9*b* show the record device 100 fully extended from the holder 200, 600, 900; that is, when the area of maximum width of the record device (either created by protrusions as shown or otherwise) prevents the record device from being further removed from the pocket. So extended, the lower edge of the record device 150 is near the top of the holder and a portion of the recording surface 110 is out of the pocket and available for reading and/or recording.

Figure 7A:
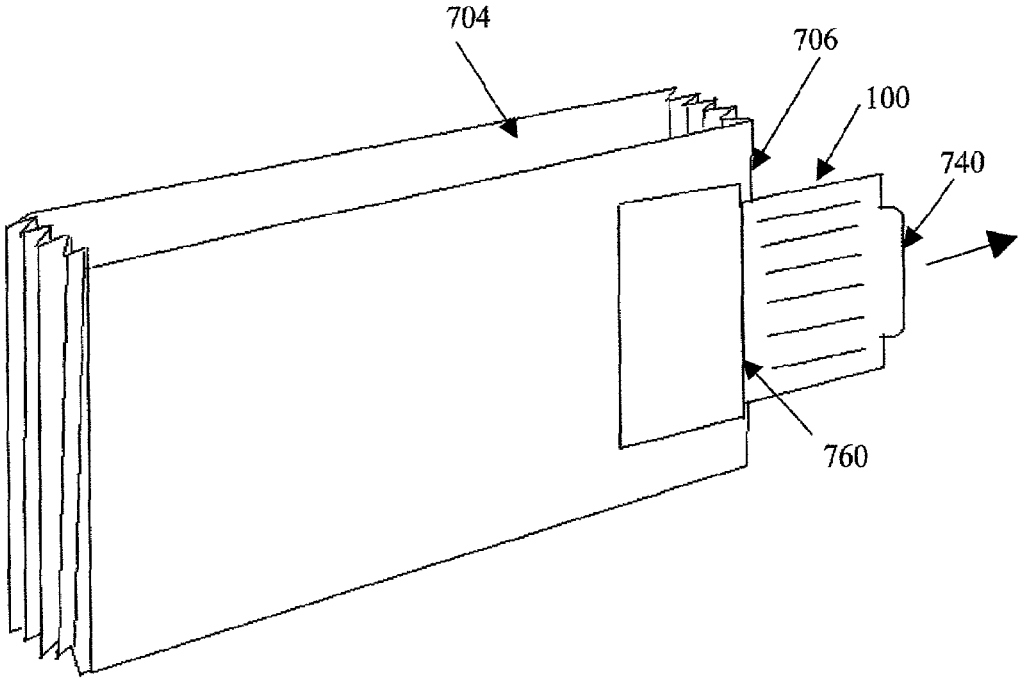
FIGS. 7*a* and 7*b* show the first embodiment of the invention in use, placed on an accordion folder and a standard manila file folder.
Figure 7B:
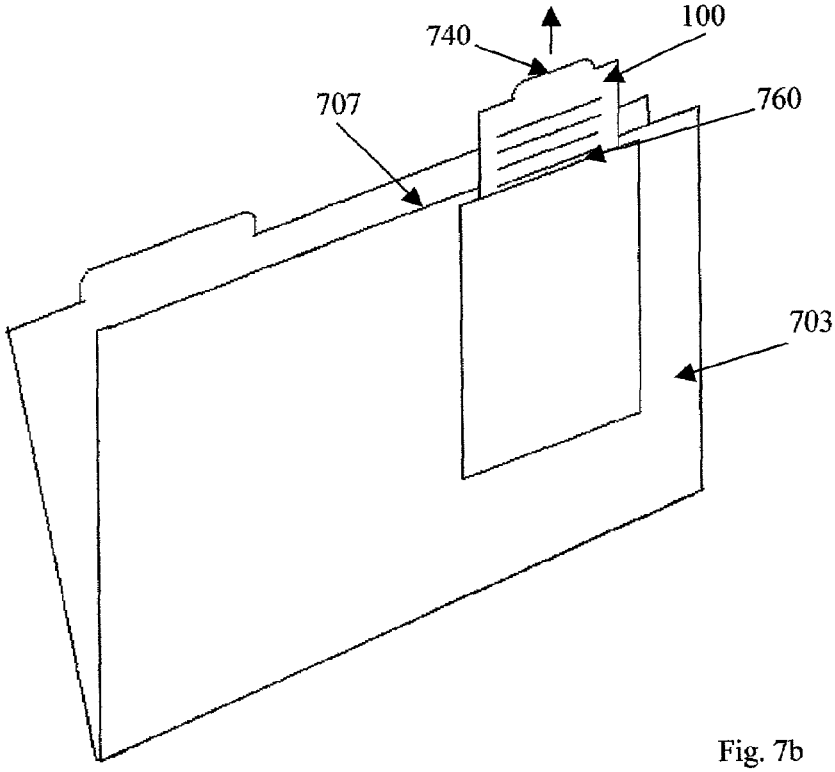

As can be seen in FIGS. 7*a* and 7*b*, a preferred placement of the device on a file folder 703 or bucket folder 704 is such that the top of the holder 760 is aligned near a side edge 706 or a top edge 707 of the folder 703, 704. Preferably, the edge 706 should be one which is accessible when the file folder is placed in its storage location—such as on a shelf—and the tab 740 or top edge of the record device should be accessible when the file is stored. It will be evident to those of ordinary skill in the art that, as shown, the position of the device shown in FIG. 7*a* would be appropriate for a file to be stored on a shelf and that the placement of the device in FIG. 7*b* would be appropriate for a file in a hanging folder or box. Normally, if the device is placed along the top edge of the file folder the placement should be chosen so as not to conflict with the tab, if any, on the file folder itself. Although placement on the outside of the folder is shown, it would be possible to place the device inside the folder, depending on the folder's construction (i.e., if the folder had open sides) and placement of the device (i.e., if the holder is to be accessed from the top of the file folder). Similar considerations would apply if the device was to be attached to a box, a book or other item.

While preferred embodiments of the present invention are described above, it is contemplated that various modifications may be made without departing from the spirit and scope of the invention.

What is claimed is:

1. An index adapted for attachment to a container comprising:

a record device and a holder;

wherein said record device is substantially planar, and has a front surface adapted for the recording of information, a back surface, a top edge defining a length, a bottom edge defining a length approximately parallel to the length of the top edge, a first side and a second side opposite the first side;

said record device further defining a maximum length near, and substantially parallel to, the bottom edge, and wherein the dimension of the top edge is less than the maximum length of the record device;

said holder comprising a first unit and a second unit, wherein the first unit and the second unit are connected together to form a substantially rectangular pocket having an interior length of approximately the maximum length of the record device and an interior width, said pocket having a pocket top defining an opening and having a pocket bottom opposite the opening;

said record device further defining a width at least as long as the interior width of the pocket and disposed within said pocket in a first position wherein the bottom edge of the record device is positioned near the opening and at least portion of the front surface extends out of the pocket, and wherein said record device is slidably moveable into the pocket to a second position wherein the bottom of the record device is positioned near the pocket bottom and a portion of the top edge of the record device extends but of the pocket and wherein the record device further comprises a protrusion extending from the first side of the record device, near the bottom edge, said protrusion defining a length approximately parallel to the bottom edge, and wherein the maximum length of the record device is equal to length of the protrusion, as measured from the side, plus the length of the bottom edge; and wherein the opening of the pocket is further defined by a stop, said stop having an open position and a closed position, and wherein the record device is disposed in the pocket such that when the record device is in the first position and the stop is in the closed position, the interior length of the pocket is greater than the length of the opening, the opening is of approximately the same length as the top edge of the record device and the protrusion contacts the stop and prevents the record device from being removed completely from the pocket, and wherein when the stop is in the open position the opening is equal to or greater than the maximum length of the record device and the record device may be removed through the opening in the pocket top.

2. An index adapted for attachment to a container comprising:

a record device and a holder;

wherein said record device is substantially planar, and has a front surface adapted for the recording of information, a back surface, a top edge defining a length, a bottom edge defining a length approximately parallel to the length of the top edge, a first side and a second side opposite the first side;

said record device further defining a maximum length near, and substantially parallel to, the bottom edge, and wherein the dimension of the top edge is less than the maximum length of the record device;

said holder comprising a first unit and a second unit, wherein the first unit and the second unit are connected together to form a substantially rectangular pocket having an interior length of approximately the maximum length of the record device and an interior width, said pocket having a pocket top defining an opening and having a pocket bottom opposite the opening;

said record device further defining a width at least as long as the interior Width of the pocket and disposed within said pocket in a first position wherein the bottom edge of the record device is positioned near the opening and at least portion of the front surface extends out of the pocket, and wherein said record device is slidably moveable into the pocket to a second position wherein the bottom of the record device is positioned near the pocket bottom and a portion of the top edge of the record device extends out of the pocket; and wherein the record device further comprises a first protrusion extending from the first side of the record device, near the bottom edge, said first protrusion defining a length approximately parallel to the bottom edge, and the record device further comprises a second protrusion extending from the second side of the record device, near the bottom edge, said second protrusion defining a length approximately parallel to the bottom edge, and wherein the lengths of the first and second protrusions lie along the same axis, such that the maximum length of the record device is equal to the total lengths of the bottom edge of the record device, and the lengths of the first protrusion as measured along the axis front the first edge of the record device and the second protrusion as measured along the axis from the second edge of the record device; and wherein the opening of the pocket is further defined by a first stop and a second stop, each of said stops having open position and a closed position, and wherein the record device is disposed in the pocket such that when the record device is in the first position and the first and second stops are each in the closed position the interior length of the pocket is greater than the length of the opening, the opening is of approximately the same length as the top edge of the record device and the first protrusion contacts the first stop and the second protrusion contacts the second stop, preventing the record device from being removed completely from the pocket; and wherein when the first stop and the second stop are each in the open position, the opening is equal to or greater than the maximum length of the record device and the record device may be removed through the opening in the pocket top.

* * * * *